US006062622A

United States Patent [19]

Susman et al.

[11] Patent Number: 6,062,622

[45] Date of Patent: May 16, 2000

[54] HANDLE CLASP FOR BAGS

[75] Inventors: Ari David Susman, Dallas; Kenneth Susman, Houston; H. Lee Evett, Pasadena, all of Tex.

[73] Assignee: Ari D. Susman, Dallas, Tex.

[21] Appl. No.: 09/209,299

[22] Filed: Dec. 10, 1998

Related U.S. Application Data

[60] Provisional application No. 60/071,886, Jan. 20, 1998, and provisional application No. 60/069,093, Dec. 11, 1997.

[51] Int. Cl.[7] ..... A45F 5/00

[52] U.S. Cl. ..... 294/149; 294/137; 294/158; 24/16 PB

[58] Field of Search ..... 294/31.2, 137, 294/149, 150, 153, 156, 158, 165, 171; 24/30.5 P, 30.5 S, 16 R, 16 PB, 17 A, 17 AP; 383/13, 24, 25; 229/117.09, 117.19, 117.23

[56] References Cited

U.S. PATENT DOCUMENTS

| | | | |
|---|---|---|---|
| 2,128,723 | 8/1938 | Zettler . | |
| 3,130,462 | 4/1964 | Mitchell | 24/16 PB |
| 3,737,945 | 6/1973 | Gould . | |
| 3,768,711 | 10/1973 | Wilkinson . | |
| 4,112,541 | 9/1978 | Tetradis . | |
| 4,176,423 | 12/1979 | Wigemark . | |
| 4,493,127 | 1/1985 | Blanke, Jr. et al. . | |
| 4,558,896 | 12/1985 | Farnworth . | |
| 4,841,596 | 6/1989 | Fink . | |
| 4,942,644 | 7/1990 | Rowley | 24/30.5 P |
| 4,982,989 | 1/1991 | Sweeny . | |
| 5,005,891 | 4/1991 | Lunsford | 294/149 |
| 5,096,248 | 3/1992 | Ryan | 294/150 |
| 5,150,938 | 9/1992 | Gans . | |
| 5,234,245 | 8/1993 | Peterson et al. | 294/149 |
| 5,263,755 | 11/1993 | Thompson . | |
| 5,601,327 | 2/1997 | Cho . | |
| 5,658,029 | 8/1997 | Franko | 294/137 |

*Primary Examiner*—Dean J. Kramer
*Attorney, Agent, or Firm*—Mark A. Oathout

[57] ABSTRACT

A handle clasp for carrying grocery bags will decrease "cutting" sensations on the hand of the user, allow the user to more easily grasp several bags at once, and reduce tumbling and spillage of the bags during transport. The handle clasp includes a slotted handle, a bag connection segment, and a head for clasping to the handle.

8 Claims, 3 Drawing Sheets

HANDLE CLASP FOR BAGS

This application claims the benefit of U.S. Provisional Applications No. 60/071,886 filed on Jan. 20, 1998 and No. 60/069,093 filed on Dec. 11, 1997.

BACKGROUND OF THE INVENTION

Every day, shoppers carry and transport groceries in bags. While carrying groceries in bags, shoppers may experience a "cutting" sensation/force on their hands and fingers. This happens particularly with plastic bags. This unpleasant feeling is due to the weight of groceries stretching the handle of the plastic bag. This results in the thin, pliable plastic handle compressing and cutting on the hands and fingers. The heavier the bags, the more the thin plastic compresses and tightens across the hands and fingers resulting in cutting sensations of larger magnitude.

In addition, when shoppers transport groceries, plastic bags may not adequately contain the groceries. For example, groceries spill out of plastic bags due to automobile acceleration, deceleration, and cornering because of the bag's lack of rigidity, its open-ended top and the instability of the groceries in the bag.

Today, stores do not utilize devices which assist shoppers in carrying bags or preventing spills. Price is the primary barrier to commercial implementation of present devices. The price of present devices is related to the complexity of the form and material used for the devices. Present devices are simple, but not simple enough to provide negligible costs to the stores while enabling them to provide shoppers with a simple and disposable means for effectively carrying and closing bags.

SUMMARY OF THE INVENTION

A handle clasp for carrying grocery bags will decrease "cutting" sensations on the hand of the user, allow the user to more easily grasp several bags at once, and reduce tumbling and spillage of the bags during transport. The handle clasp includes a slotted handle, a bag connection segment, and a head for clasping to the handle.

Certain embodiments of this invention are not limited to any particular individual features disclosed, but include combinations of features distinguished from the prior art in their structures and functions. Features of the invention have been broadly described so that the detailed descriptions that follow may be better understood, and in order that the contributions of this invention to the arts may be better appreciated. There are, of course, additional aspects of the invention described below. These may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes, addresses and meets the previously-mentioned preferences or objectives in its various possible embodiments and equivalents thereof. To one of skill in this art who has the benefit of this invention's realizations, teachings, disclosures, and suggestions, other purposes and advantages will be appreciated from the following description and the accompanying drawings. The detail in the description is not intended to thwart this patent's object to claim this invention no matter how others may later disguise it by variations in form or additions of further improvements. These descriptions illustrate certain preferred embodiments and are not to be used to improperly limit the scope of the invention which may have other equally effective or legally equivalent embodiments.

DETAILED DESCRIPTION

Figure 1:
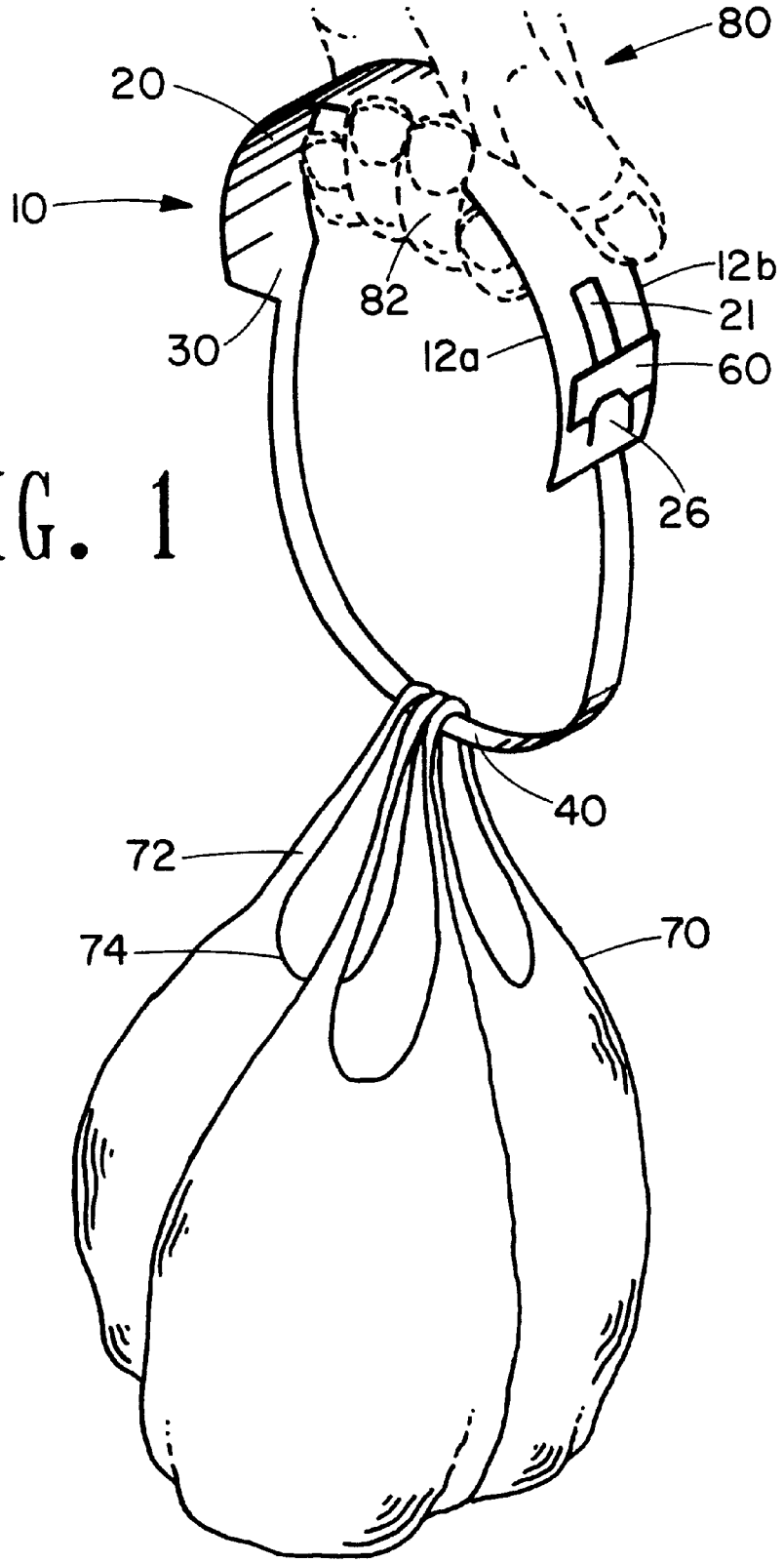
FIG. 1 is a perspective view of a handle clasp holding together three plastic bags.

Referring to FIG. 1, the present invention relates to a handle clasp 10, which when connected through handles 72 of bags 70 such as plastic bags, reduces the cutting force/sensation into the hands 80 and fingers 82 experienced when carrying groceries and joins the tops of the bags 70 to prevent spills during transport.

The handle clasp 10 is preferably made of 1/16" thick plastic or a similarly flexible material. The material must have a sufficient yield strength in tension to carry numerous bags of groceries yet, preferably, be supple or pliable.

Figure 2:
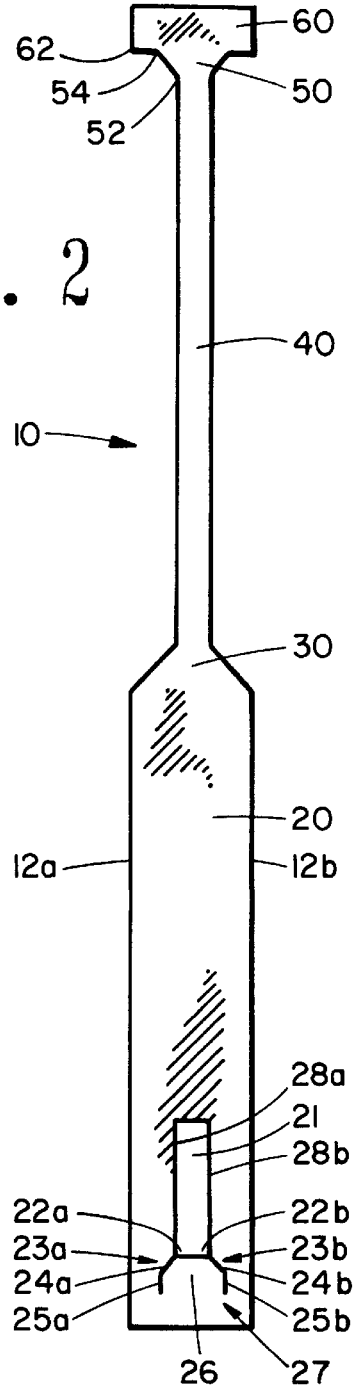
FIG. 2 is an elevational view of an unconnected and extended handle clasp.

Referring to FIG. 2, handle clasp 10 consists of a handle 20, tapered handle segment 30, bag connection segment 40, tapered clasp segment 50, and head 60.

Handle 20 is approximately 6.75" long and 1" wide. Handle 20 contains a slot 21. Slot 21 is approximately 1" long and 0.25" wide and is located near base 27 of handle 20. Near the base of the slot 21, are the slot corners 22*a,b* which have two slits 23*a,b*. Slits 23*a,b* are composed of angular portions 24*a,b* and straight portions 25*a,b*. Angular slit portions 24*a,b* are at a forty-five degree outward angle from corners 22*a,b* and approximately 3/16" in length. Straight slit portions 25*a,b* are approximately 3/16" in length. Slits 23*a,b* form a lip 26 which protrudes from the body of handle 20 (see FIG. 3).

Handle 20 tapers from a width of 1" to a width of 3/16" over a span of approximately 3/16" forming a tapered handle segment 30. Tapered handle segment 30 transitions into a bag connecting segment 40.

Bag connection segment 40 is approximately 5.25" long and 3/16" wide. The width of bag connection segment 40 is smaller than the width of the slot 21. Bag connection segment 40 is the most flexible portion of the handle clasp 10 due to the small width of the bag connection segment 40. Bag connection segment 40 transitions into tapered clasp segment 50.

The tapered clasp segment 50 tapers from a lower end 52 which is the same width as bag connection segment 40 (having a close tolerance to the edges 28*a* and *b* of slot 21) to the other end 54 which is approximately the same width (from straight portion 25*a* to straight portion 25*b*) as lip 26. Tapered clasp segment 50 transitions into head 60 which is rectangular in shape and approximately 3/8" long and 1" wide. Tapered clasp segment 50 also inhibits a tear in the handle clasp 10 by distributing forces across the segment 50 when head 60 is twisted and/or pulled.

Figure 3:
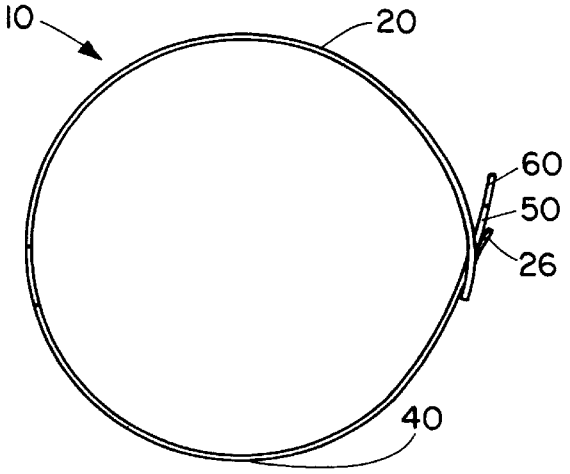
FIG. 3 is a side view of a connected handle clasp.

When using the handle clasp 10, a user grabs bag connection segment 40 (or head 60) and twists segment 40 approximately ninety degrees. Next, head 60 is inserted into slot 21. Referring to FIGS. 1 and 3, the user then releases the twisting force, and head 60 rotates/returns to its natural position in which the longest axis of head 60 is perpendicular to the longest axis of slot 21 to join the ends of handle clasp 10.

As a result, the lower end 52 of tapered clasp segment 50 rests above and against the edges 28 of the slot 21 thus preventing handle 20 from contacting head 60 when there is no downward force supplied by bags 70. However when bags 70 are lifted by the user via handle clasp 10, the weight of the bags 70 forces the tapered clasp segment 50 to slide under lip 26 until locking edge 62 of head 60 (or the upper end 54 of the tapered clasp segment 50) interferes with the edges 28 of slot 21. As the handle clasp 10 may be made from a thin, supple material lip 26 in conjunction with angular portions 24*a,b* and straight slit portions 25*a,b* function to lock or inhibit the head 60 from curling or bending and sliding through slot 21.

Plastic bags 70 may now be carried with reduced "cutting" forces on the shopper's hand 80 and fingers 82 because the handles 72 "cut" across the bag connection segment 40 rather than fingers 82 and hands 80. A larger width of the handle segment 20 serves to distribute forces more evenly across the hand 80 and fingers 82 resulting in less concentrated, reduced cutting forces on the hand 80 and fingers 82. Also, outer edges 12a and b on the handle clasp 10 may be manufactured to be smooth or dull.

In addition, the handle clasp 10 when placed through all handles 72 serves to provide stability in that it will "close" and/or "join" the handles 72 and tops 74 of plastic bags 70 over the groceries and maintain them in this state until the handle clasp 10 is unclasped such that groceries will not spill out of bags 70. This feature is particularly useful when grocery bags are placed in an automobile where bags in transport have a tendency to collapse and/or roll/tip over and spill. As such, the handle clasp 10 should remain clasped until after the contents are transported and removed from the vehicle. This feature may be enhanced when more than one bag 70 is clasped to a single handle clasp 10.

Figure 4:
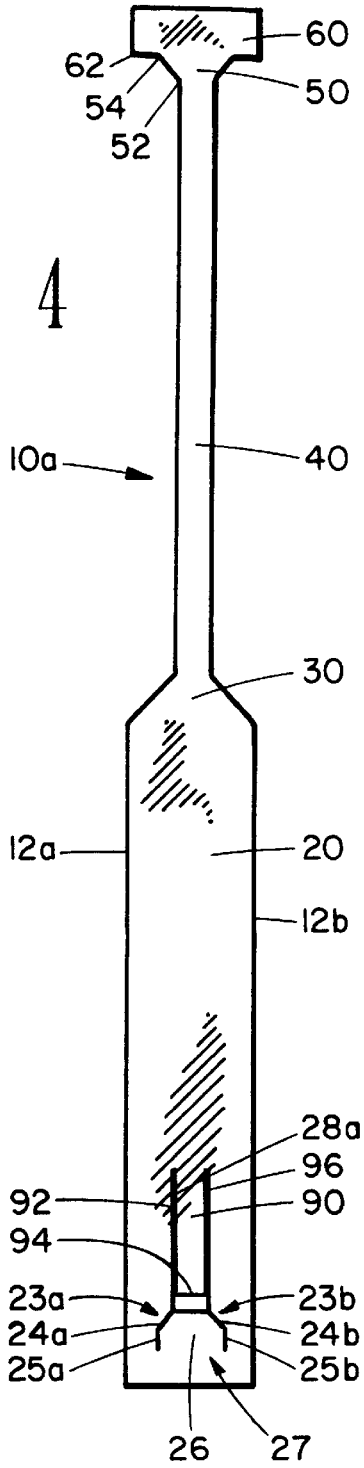
FIG. 4 is an elevational view similar to FIG. 2 showing another embodiment of the invention.
Figure 5:
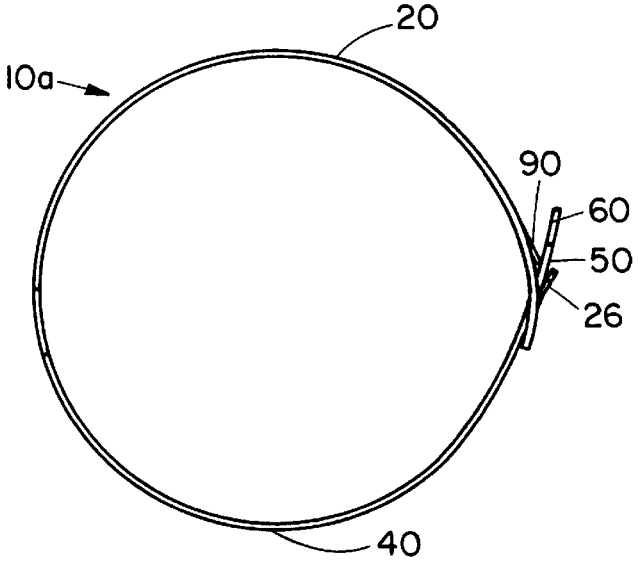
FIG. 5 is a view similar to FIG. 3 showing the embodiment of the invention shown in FIG. 4.

Referring to FIGS. 4 and 5 another embodiment of the invention is shown. This embodiment 10*a* is similar to the embodiment 10 shown in FIGS. 1–3 except it includes a tab or tongue 90 which helps to lock the head 60 in place. The tongue 90 has three edges 92, 94 and 96 which are created when tongue 90 is cut away from the handle 20. In use, for clasping the handle 20, the head 60 is pushed through the tongue 90. The tongue 90 is then placed under the head 60 (see FIG. 5). The tongue 90 acts to inhibit the head 60 from twisting or bending and coming unclasped/popping out of handle 20, i.e. to lock the head 60 in place. The length of the edges 92, 94 and/or 96 may be increased or decreased as necessary to assist in the locking feature of the invention. As described above, head 60 may be additionally locked under lip 26.

Therefore, it is seen that the present invention is well adapted to carry out the objectives and obtain the ends set forth. With such a simple and inexpensive device, stores are now able to provide shoppers an improved means to carry and transport items in plastic bags while incurring minimal costs. The handle clasp 10*a* may also be used for holding hangers for airline or other travel, for locking around clothes picked up at the dry cleaners, for locking around a hook or handle mounted in an automobile, etcetera. The handle 20 can be used for the placement of advertisements, promotions, coupons, logos, etc.

Certain changes can be made in the subject matter without departing from the spirit and the scope of this invention. It is realized that changes are possible within the scope of this invention and it is further intended that each element or step recited in any claims is to be understood as referring to all equivalent elements or steps. The claims are intended to cover the invention as broadly as legally possible in whatever form it may be utilized.

What is claimed is:

1. A clasp for connecting one or more devices to another device, comprising:

a unitary strip wherein said unitary strip includes:

a handle having a slot defined by a top, two edges and a base;

a bag connection segment integral with and adjoining said handle, said bag connection segment having a width which is less than a width of the slot;

a head integral with and adjoining said bag connection segment; and wherein said handle includes a means for locking said head, said locking means adjoining the slot wherein said locking means comprises a lip defined by said handle having two slits, one each extending from one of two corners of the base of the slot.

2. The clasp according to claim 1 wherein the two slits each have an angular portion which angles outward from the corner of the base and a straight portion which extends from the angular portion in a direction parallel to the edges of the slot.

3. The clasp according to claim 1 wherein said handle further includes a tongue integral with and adjoining the top of the slot and having three tongue edges, one each adjacent the edges and the base of the slot.

4. A clasp for connecting one or more devices to another device, comprising:

a unitary strip wherein said unitary strip includes:

a handle having a slot defined by a top, two edges and a base;

a bag connection segment integral with and adjoining said handle, said bag connection segment having a width which is less than a width of the slot;

a head integral with and adjoining said bag connection segment;

wherein said handle includes a lip defined by said handle having two slits, one each extending from one of two comers of the base of the slot; and wherein said handle further includes a tongue integral with and adjoining the top of the slot and having three tongue edges, one each adjacent the edges and the base of the slot.

5. The clasp according to claim 4 wherein the two slits each have an angular portion which angles outward from the corner of the base and a straight portion which extends from the angular portion in a direction parallel to the edges of the slot.

6. A method of using the clasp according to claim 4, including the steps of:

twisting said head;

pushing said head through said tongue and through the slot;

placing said tongue under said head; and locking said head in said lip.

7. A clasp for connecting one or more devices, to another device, comprising:

a unitary strip wherein said unitary strip includes:

a handle having a slot defined by a top, two edges and a base wherein said handle further includes a tongue integral with and adjoining the top of the slot and having three tongue edges, one each adjacent the edges and the base of the slot;

a bag connection segment integral with and adjoining said handle, said bag connection segment having a width which is less than a width of the slot;

a head integral with and adjoining said bag connection segment; and wherein said handle includes a means for locking said head, said locking means adjoining the slot.

8. A method of using the clasp according to claim 7, including the steps of:

twisting said head;

pushing said head through said tongue and through the slot;

placing said tongue under said head; and locking said head in said locking means.

* * * * *